US005551490A

United States Patent [19]

Kountz et al.

[11] Patent Number: 5,551,490

[45] Date of Patent: Sep. 3, 1996

[54] APPARATUS AND METHOD FOR CONTROLLING THE CHARGING OF NGV CYLINDERS FROM NATURAL GAS REFUELING STATIONS

[75] Inventors: Kenneth J. Kountz, Palatine; Christopher F. Blazek, Palos Hills, both of Ill.

[73] Assignee: Gas Research Institute, Chicago, Ill.

[21] Appl. No.: 483,380

[22] Filed: Jun. 7, 1995

Related U.S. Application Data

[62] Division of Ser. No. 237,001, May 2, 1994, Pat. No. 5,488, 978.

[51] Int. Cl.[6] ..... B65B 31/00

[52] U.S. Cl. ..... 141/21; 141/83; 141/18; 141/95; 141/197

[58] Field of Search ..... 141/2–5, 18, 21, 141/83, 95, 197

[56] References Cited

U.S. PATENT DOCUMENTS

| | | | |
|---|---|---|---|
| 4,527,600 | 7/1985 | Fisher et al. | 141/4 |
| 4,657,055 | 4/1987 | Poulsen | 141/83 |
| 4,813,461 | 3/1989 | Fanshawe et al. | 141/4 |
| 4,966,206 | 10/1990 | Baumann et al. | 141/83 |
| 5,029,622 | 7/1991 | Mutter | 141/4 |
| 5,238,030 | 8/1993 | Miller et al. | 141/4 |
| 5,259,424 | 11/1993 | Miller et al. | 141/4 |

*Primary Examiner*—J. Casimer Jacyna
*Attorney, Agent, or Firm*—Dick and Harris

[57] ABSTRACT

An apparatus and system for the fast-filling of cylinders for natural gas powered vehicles, employing a simplified physical arrangement and an improved control method to obtain maximum safe filling of the cylinders, which takes into account the presence of residual gas in the cylinders.

3 Claims, 1 Drawing Sheet

APPARATUS AND METHOD FOR CONTROLLING THE CHARGING OF NGV CYLINDERS FROM NATURAL GAS REFUELING STATIONS

This is a division of application Ser. No. 08/237,001, filed May 2, 1994, now U.S. Pat. No. 5,488,978.

BACKGROUND OF THE INVENTION

1. Field of the Invention

The present invention relates to the field of natural gas powered vehicles, and in particular to the methods for filling the cylinders for such vehicles.

2. The Prior Art U.S. Pat. No. 4,966,206 to Baumann et al. discloses a device for filling a gaseous fuel container.

The Baumann et al. device is configured to adjust the filling procedure to the local ambient temperature, in order to control the pressure of the gas with which the container is filled, toward obtaining a filling of the container, at ambient temperature, which corresponds to the rated filling pressure of the container at a standard temperature. A casing is provided, containing a control device. The ambient temperature, the pressure of the gas to be supplied at the outlet of a compressor, and the pressure differential between the pressure in an inlet line to the casing and the pressure within the casing itself, are all sensed and the control device adjusts the supply pressure of the gas accordingly.

U.S. Pat. Nos. 5,238,030 and 5,259,424 to Miller et al. are directed to filling devices and methods, in which a known quantity of gas is metered into a container. By measuring the stagnation pressure and temperature of the gas, the ambient temperature, and the supply pressure of the gas, the available volume in the container, and thus the mass which can be filled, to the rated pressure of the container, can be determined. The device then meters the calculated amount into the container. Alternatively, the device meters a substantial fraction of the calculated amount, in order to accommodate possible error, and then adds gas in increments, until a cut-off pressure, which is calculated, based upon the ambient temperature, is reached. The pressure within the container is sensed intermittently, during the filling procedure.

Mutter, U.S. Pat. No. 5,029,622 discloses a "slow-fill" system which is configured to accommodate ambient temperature changes which take place during the filling process.

The attainment of accuracy during the filling process for cylinders for natural gas vehicles is important, for the future development of such vehicles, both from a potential commercial standpoint, in order that natural gas "fueling station" can be operated in an efficient and commercially viable manner, and from an operator standpoint, so that maximum operating ranges and maximum vehicle safety can be obtained.

Filling accuracy is particularly problematic during fast filling operations (five minutes or less), since the actual filling procedure can have an effect upon the accuracy of the procedure. For example, the ambient temperature must be considered, although once determined, it can be assumed to be constant, due to the speed of the filling process.

As a container is filled, its internal pressure rises during the filling process, and in some filling procedures is monitored to help determine when proper filling has occurred. However, during a fast filling procedure, the temperature of the natural gas within the container rises, which, in turn further increases the pressure within the container. The amount of temperature rise which occurs in the tank has been found to be a function of the amount and pressure of any residual natural gas which is in the container, at the time of filling. Therefore, it is desirable to provide a method and apparatus for the fast filling of cylinders, for example for natural gas, which achieves an improved filling of such cylinders, taking into account environmental conditions, the characteristics of the supply gas, and the characteristics of the cylinder to be filled, including any residual gas remaining in the cylinder.

SUMMARY OF THE INVENTION

The invention comprises a system for the rapid filling of containers with a fluid, such as natural gas, under pressure, wherein each container has a known pressure rating at standard ambient pressure and temperature, and an unknown amount of residual gas remaining therein. The system, in combination with one or more of said containers, comprises a source of gas; means for directing the flow of the gas from the source to one or more of the containers; means for sensing the temperature and pressure of the gas being supplied by the source, and producing indications representative of the temperature and pressure; means for sensing the pressure within the one or more containers, and producing an indication representative of the pressure in the one or more containers, the means for sensing the pressure within the one or more containers being capable of sensing an initial pressure within the one or more containers, and thereafter substantially continuously sensing the pressure within the one or more containers; means for sensing an initial temperature of the one or more containers prior to filling thereof; and control means for determining a cutoff pressure to which the one or more containers can be filled, the cutoff pressure being based upon the initial pressure within the one or more containers, the initial temperature of the one or more containers, and the temperature and pressure of the gas being supplied by the source, the control means being operably associated with the means for sensing the temperature and pressure of the gas being supplied, the means for sensing the pressure within the one or more containers and the means for sensing the initial temperature of the one or more containers.

In a preferred embodiment of the invention, the control means further comprises means for storing data, previously computed from a model of the charging process, corresponding to predetermined final filled pressure values for the one or more containers, the predetermined final filled pressure values corresponding to a plurality of predetermined temperatures and pressures of gas which could be supplied by the source, and to a plurality of initial container pressures and ambient temperatures; means for comparing the indications provided by the means for sensing the temperature and pressure of the gas being supplied, the means for sensing the pressure within the one or more containers and the means for sensing the initial temperature of the one or more containers, with the data corresponding to predetermined final filled pressure values; and means for interpolating the indications provided by the means for sensing the temperature and pressure of the gas being supplied, the means for sensing the pressure within the one or more containers and the means for sensing the initial temperature of the one or more containers, in the event that said indications do not correspond exactly to the plurality of predetermined temperatures and pressures of gas which could be supplied by the source, and to a plurality of initial container pressures and ambient temperatures, to determine appropriate intermediate final filled pressure values for the one or more containers.

The system for the rapid filling of containers further comprises means for stopping the flow of gas from the source, operably associated with and responsive to the control means.

The invention also comprises a method for the rapid filling of containers with a fluid, such as natural gas, under pressure, wherein each container has a known pressure rating at standard ambient pressure and temperature, and an unknown amount of residual gas remaining therein.

The method comprises the steps of providing a container to be filled, having an unknown quantity of residual gas therein; connecting the container to a source of gas, the gas being deliverable at a pressure sufficient to fill the container with a mass of gas equivalent to a filled container at a standard temperature and pressure; sensing the ambient temperature in the vicinity of the container to be filled; sensing the pressure of the gas being supplied from the source; sensing the initial pressure, prior to filling, of the residual gas within the container to be filled; determining an appropriate cut-off pressure within the container to be filled, based upon the ambient temperature, the initial pressure of the container to be filled, and the source pressure; initiating flow of gas from the source into the container to be filled; monitoring continuously the pressure within the container to be filled; comparing the monitored pressure with the determined cut-off pressure; and interrupting flow of the gas from the source to the container to be filled when the monitored pressure achieves a predetermined fraction of the predetermined cut-off pressure.

The step of determining an appropriate cut-off pressure within the container to be filled, based upon the ambient temperature, the initial pressure of the container to be filled, and the source pressure, sure further comprises the steps of storing, in memory in a control device operably associated with the source of gas, information corresponding to a plurality of possible values for the ambient temperature, the initial pressure of the container to be filled, and the source pressure; storing, in other memory in the control device, information corresponding to a plurality of cut-off pressures corresponding to particular ones of the possible values for the ambient temperature, the initial pressure of the container to be filled, and the source pressure; comparing the sensed ambient temperature, the initial pressure of the container to be filled, and the source pressure, with the stored possible values for the ambient temperature, initial pressure of the container to be filled and the source pressure; and retrieving from the other memory, a cut-off pressure associated with the stored possible values of ambient temperature, initial container pressure and source pressure which correspond to the sensed ambient temperature, initial container pressure and source pressure.

BEST MODE FOR CARRYING-OUT THE INVENTION

Figure 1:
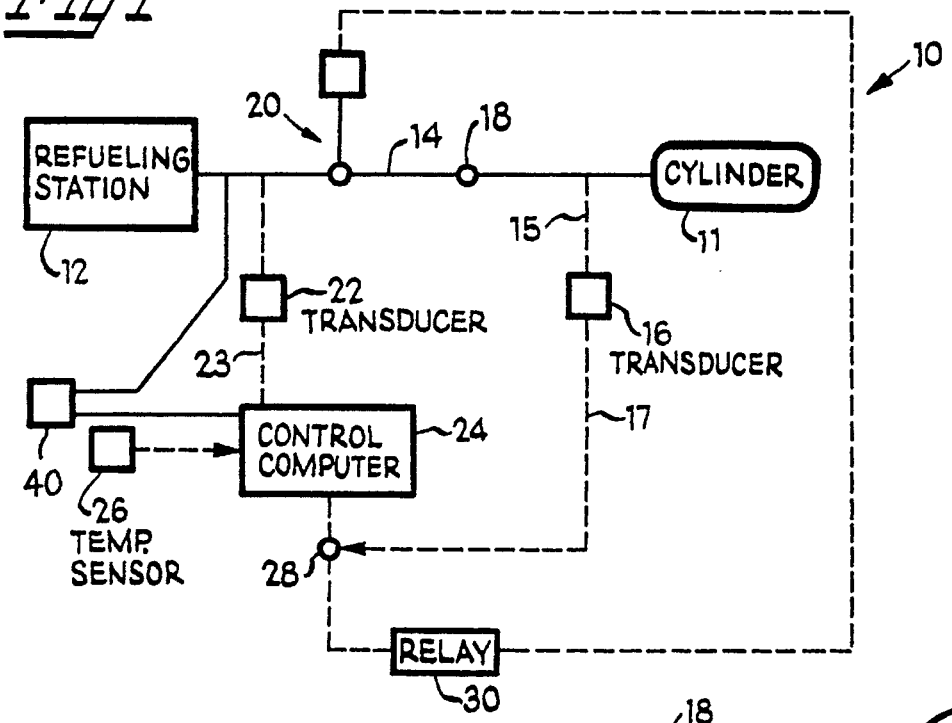
FIG. 1 is a schematic representation of the apparatus for the adiabatic filling of containers, according to a first embodiment of the invention.

While the present invention is susceptible of embodiment in many different forms, there is shown in the drawings and will be described herein in detail, several specific embodiments, with the understanding that the present disclosure is to be considered as an exemplification of the principles off the invention, and is not intended to limit the invention to the embodiments illustrated.

FIG. 1 shows schematically, the filling system 10 according to one embodiment of the invention. Vehicle storage cylinder 11 is Connected to gas refueling station 12 by suitable piping 14. A pressure transducer 16 of known configuration is located on piping 14 at a position downstream of check valve 18. Pressure transducer 16 is configured to be able to continually sense the pressure within vehicle storage cylinder 11. Check valve 18 is configured to only allow flow toward cylinder 11. A cut-off valve 20, which may be, for example, a solenoid valve, is located upstream of check valve 18. A second pressure transducer 22, also of known configuration, is located upstream of cut-off valve 20. Temperatures sensor 40 senses the gas source temperature.

Both pressure transducers 16 and 22 are arranged so as to supply signals, 17 and 23, respectively, to control computer 24. Likewise, a temperature sensor 26, located so as to sense the refueling station's ambient temperature, is arranged to feed its signals to control computer 24. In a manner discussed further hereinafter, control computer applies the information contained in the signals from pressure transducers 16, 22, and temperature sensor 26, and establishes a cut-off pressure, which is schematically represented as point 28. During the refueling procedure, if the pressure sensed by pressure transducer 16 exceeds the cut-off pressure 28, then relay 30 is actuated so as to cause cut-off valve 20 to close pipeline 14, and stop the flow of gas into vehicle storage cylinder 11.

Figure 2:
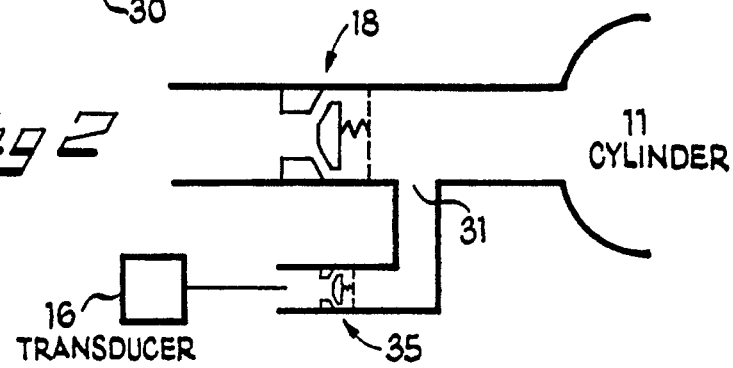
FIG. 2 is a schematic representation of a container fill valve configuration, according to the embodiment of FIG. 1.

In the embodiment shown in FIG. 1, it is contemplated that, for purposes of sensing the cylinder pressure, a cylinder pressure sensing port 31 provided on each cylinder 11, with its own check valve 35. This arrangement is indicated schematically in FIG. 2. Pressure transducer 16 would not, in a preferred embodiment, be located on cylinder 11, as this construction would increase the cost of each cylinder 11. Pressure transducer 16 would therefore be part of the equipment of refueling station 12. During the operation of connecting cylinder 11 to refueling station 12, the fill nozzle (not shown) for cylinder 11, which would be of known construction, would open the pressure sensing check valve 35. The pressure signal 17 would be directed to the control computer 24 as indicated. Accordingly, the fill nozzle would contain two lines, one, line 14 supplying the gas to fill cylinder 11, and another, line 15, leading to pressure transducer 16, for sensing the cylinder pressure.

Figure 3:
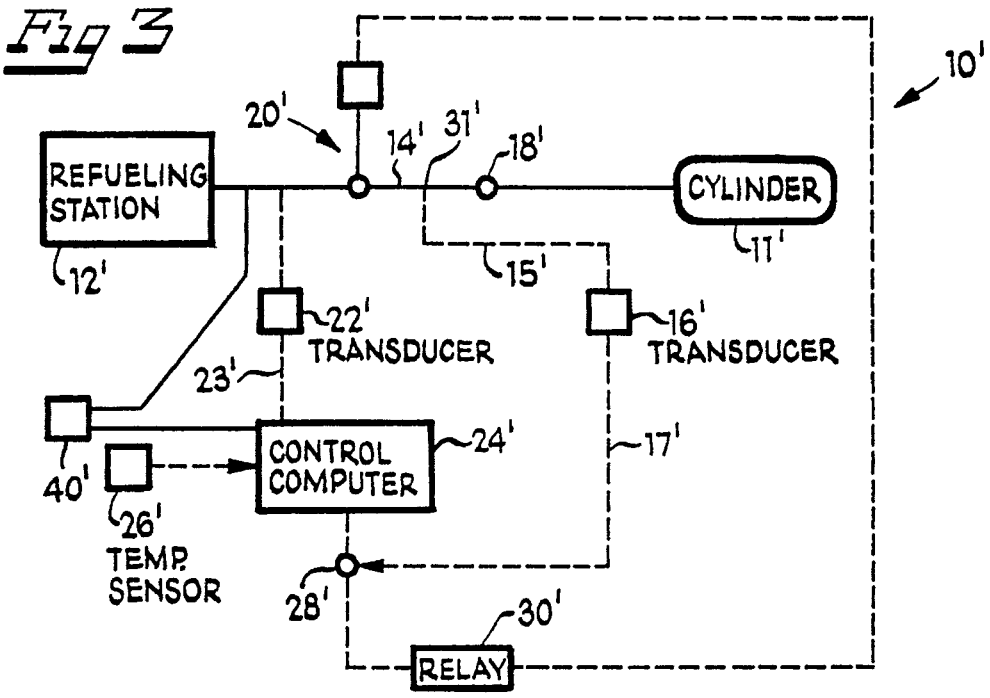
FIG. 3 is a schematic representation of the apparatus for the adiabatic filling of containers, according to a second embodiment of the invention.

In the alternative embodiment of FIG. 3, elements having structures and/or functions similar or substantially identical to those described with reference to the previous embodiment, are designated with like reference numerals followed by a prime (′). In filling system 10′, cylinder pressure sensing port 31′ is located upstream of check valve 18′. Temperature sensor 40′ senses the gas source temperature. In this embodiment, the volume of the line 15′ from pressure sensing port 31′ to pressure transducer 16′, and the volume of line 14′ from pressure sensing port 31′ to cylinder 11′ are assumed to be small, relative to the volume of cylinder 11′ itself. Further, check valve 18′ is assumed to offer little flow resistance during the filling process, and the diameter of line 14′ between check valve 18′ and cylinder 11′ is assumed to be relatively large. Given the foregoing assumptions, cylinder pressure readings taken from port 31′ should also provide accurate determinations of the pressure in cylinder 11′ during a filling process. The configuration of the embodiment of FIG. 3 would then allow the accurate filling of cylinders 11' which are not provided with their own pressure sensing ports.

In either embodiment, the operation of filling system 10 (10' ) is the same, as previously described.

In the prior art, if a cylinder, having a known volume and initial temperature is filled with gas at a known temperature, to a specified pressure (assuming a filling process slow enough not to permit an accumulation of heat, and corresponding temperature rise, within the cylinder), the amount of mass put into the cylinder can be determined by the final cylinder pressure. Accordingly, if the cylinder pressure is monitored continually, and a cut-off pressure has been calculated, based upon the characteristics of the cylinder (rated pressure, etc.) and the ambient temperature, a safe filling of the cylinder can be accomplished.

However, such a filling process can be expected to take up to several hours, which is an unacceptable fill time for many applications. For example, such fill times make commercial natural gas filling stations for private natural gas powered vehicles (NGV's), analogous to current gasoline filling stations, impractical. To make such applications practical, fill times of five minutes or less are needed.

During a fast filling procedure, there is not sufficient time for the heat, which accumulates in the cylinder, to dissipate, since the heat capacity of such cylinders, is not high enough, particularly if the cylinders are made of composite materials, to save weight. This is known as an adiabatic filling process. Since the gas temperature is rising, the cylinder static pressure which is observed will not accurately reflect the mass which has been inletted into the cylinder. Likewise, it would be difficult to determine the instantaneous temperature of the gas in the cylinder during the refueling process. The mass would only be accurately reflected by the static pressure in the cylinder, once the built-up heat in the cylinder had an opportunity to dissipate, so that the cylinder would return to a standard (e.g., 70° F.) or at least stabilized temperature.

In addition, the amount and pressure of residual gas left in the cylinder prior to filling will affect the amount of temperature rise which will occur during the filling process.

In order to determine a cut-off pressure, which will accurately reflect a safely filled cylinder, at a standard temperature and pressure, the following set of differential equations require solution:

In which:

=Mass in receiving cylinder $P_r$=Pressure in receiving cylinder $T_r$= Temperature in gas receiving cylinder $V_r$=Volume of receiving cylinder $$\frac{dQ_r}{dt} = \text{heat transfer rate entering receiving cylinder}$$

$C_{pw}$=Cylinder wall specific heat $$\frac{dQ_a}{dt} \text{ Heat transfer rate out receiver cylinder wall into ambient}$$

$$\frac{dQ_w}{dt} \text{ Net heat transfer rate into cylinder wall}$$

$h_{amb}$= The surface heat transfer coefficient of the receiving cylinder on its ambient surface $h_{cyl}$=The surface heat transfer coefficient of gas inside the receiving cylinder $h_s$=The specific enthalpy of the supply gas $M_w$=Cylinder wall mass R=Universal gas constant $U_r$=Specific internal energy of gas in cylinder $W_1$=Mass flow rate into cylinder $Z_r$=Compressibility factor of the gas $A_{cyl}$=Cylinder surface area $T_a$=Ambient temperature $T_w$=Cylinder wall temperature 1. Energy $$\frac{dQ_r}{dt} + W_1 h_s = \frac{d(M_r u_r)}{dt}$$

2. Conservation of Mass $$\frac{dM_r}{dt} = W_1 W_1 = f(P_s, T_s, P_r, \ldots)$$

3. Equation of State $$P_r V_r = R Z_r M_r T_r$$

or $$V_r \frac{dP_r}{dt} = R \frac{d}{dt} (Z_r M_r T_R)$$

4. Heat Transfer Equations $$\frac{dQ_r}{dt} = -h_{cyl} A_{cyl} (T_r - T_w)$$

$$\frac{dQ_a}{dt} = h_{amb} A_{cyl} (T_w' - T_{amb})$$

$$\frac{dQ_w}{dt} = \frac{-dQ_r}{dt} - \frac{dQ_a}{dt}$$

$$\frac{dT_w}{dt} = \frac{1}{m_w c p_w} \frac{dQ_w}{dt}$$

In order to define solutions of the above-listed set of equations, the following list of parameters which will be known or can be dictated in a contemplated refueling station are used:

a. orifice area of the cylinder aperture;

b. ambient air temperature;

c. cylinder (interior) side heat transfer coefficient;

d. surface area of cylinder;

e. volume of cylinder;

f. ambient side (exterior) heat transfer coefficient;

g. mass of the cylinder wall;

h. specific heat of the cylinder wall i. type of gas (known physical characteristics), whether pure methane or a mean U.S. natural gas composition;

j. pressure of the supply gas;

k. temperature of the supply gas;

L. pressure of the cylinder gas;

m. pressure of the residual cylinder gas; and n. temperature of the residual cylinder gas.

Solutions of this equation set has been obtained using known computer differential equation solution methods. In particular, a Runge Kutta Fourth Order Method has been used, although other solution methods may be used.

In order to reduce the number of variable parameters for which solutions must be obtained, certain ones of the parameters are assumed to be constant, or of limited alternatives. For example, two standardized cylinders, one of aluminum composite matrix wrapping, and one of steel composite matrix wrapping, and of specific physical dimensions can be assumed, so as to correspond to the two general types of cylinders in present and/or contemplated commercial practice. A single orifice area can be assumed. The ambient temperature and the cylinder gas temperature can be assumed to be equal. The supply gas pressure and temperature can be dictated, to be adequate to accomplish filling of any cylinder, to rated filling. For example, a standard 10" diameter, 50" tall cylinder, would have, as a target pressure, at standard temperature of 70° F, a final static gas pressure of 3000 psia (pounds per square inch absolute). Therefore, the supply pressure would be set at 3000 psia, or a higher value, such as 4000 psia.

In addition, since this system is directed to substantially adiabatic filling of the cylinder (five minutes or less), heat transfer to or from ambient, directly into the cylinder, or into the supply piping, during the filling procedure, can be considered to be negligible, and thus the related parameters and constants can be omitted or placed at zero.

Solution of the equation set, using the defined and/or omitted parameters yields a set of curves plotting final cylinder pressures, at standard temperature (or other temperature, if desired), against initial cylinder pressure values, for varying supply pressures, for a specified maximum filling time (.e.g., five minutes). Accordingly, a cut-off pressure, representing a maximum, safe, normalized static gas pressure for the cylinder, corresponding to the initial cylinder pressure, and the supply gas temperature and pressure, can be obtained.

What is claimed is:

1. A system for the rapid, substantially adiabatic, filling of containers with a gas, under pressure, wherein each container has a known pressure rating at standard ambient pressure and temperature, and an unknown amount of residual gas remaining therein, said system, in combination with one or more of said containers, comprising:

a source of gas;

means for directing the flow of the gas from the source to one or more of the containers;

means for sensing the temperature and pressure of the gas being supplied by the source, and producing indications representative of the temperature and pressure;

means for sensing the pressure within the one or more containers, and producing an indication representative of the pressure in the one or more containers, said means for sensing the pressure within the one or more containers being capable of sensing an initial pressure within the one or more containers, and thereafter substantially continuously sensing the pressure within the one or more containers, while the flow of gas from the source into the container is substantially continuous and uninterrupted during the filling process;

means for sensing an initial temperature of the one or more containers prior to filling thereof;

control means for determining a cutoff pressure to which the one or more containers can be filled, the cutoff pressure being based upon the initial pressure within the one or more containers, the initial temperature of the one or more containers, and the temperature and pressure of the gas being supplied by the source and presuming that substantially no heat transfer occurs between the container and the surrounding environment, during the filling of the container, the control means being operably associated with the means for sensing the temperature and pressure of the gas being supplied, the means for sensing the pressure within the one or more containers and the means for sensing the initial temperature of the one or more containers, the control means being further configured for determining and achieving filling of the container to a predetermined level.

2. The system for the rapid filling of containers, according to claim 1 wherein the control means further comprises:

means for storing data corresponding, to predetermined final filled pressure values for the one or more containers, the predetermined final filled pressure values corresponding to a plurality of predetermined temperatures and pressures of gas which could be supplied by the source, and to a plurality of initial container pressures and ambient temperatures;

means for comparing the indications provided by the means for sensing the temperature and pressure of the gas being supplied, the means for sensing the pressure within the one or more containers and the means for sensing the initial temperature of the one or more containers, with the data corresponding to predetermined final filled pressure values;

means for interpolating the indications provided by the means for sensing the temperature and pressure of the gas being supplied, the means for sensing the pressure within the one or more containers and the means for sensing the initial temperature of the one or more containers, in the event that said indication do not correspond exactly to the plurality of predetermined temperatures and pressures of gas which could be supplied by the source, and to a plurality of initial container pressures and ambient temperatures, to determine appropriate intermediate final filled pressure values for the one or more containers.

3. The system for the rapid filling of containers, according to claim 1, further comprising:

means for stopping the flow of gas from the source, operably associated with and responsive to the control means.

* * * * *